US005568980A

United States Patent [19]

Kristola

[11] Patent Number: 5,568,980

[45] **Date of Patent: *Oct. 29, 1996**

[54] QUASI-HEAT SEAL SOS BAG

[75] Inventor: Jay L. Kristola, Kiel, Wis.

[73] Assignee: H.G. Weber Co., Inc., Kiel, Wis.

[ * ] Notice: The term of this patent shall not extend beyond the expiration date of Pat. No. 5,472,282.

[21] Appl. No.: 352,503

[22] Filed: Dec. 9, 1994

[51] Int. Cl.[6] ..... B65D 30/18

[52] U.S. Cl. ..... 383/126; 383/125

[58] Field of Search ..... 383/121, 123, 383/124, 125, 126

[56] References Cited

U.S. PATENT DOCUMENTS

| | | | |
|---|---|---|---|
| 333,523 | 1/1886 | Honiss . | |
| 388,614 | 8/1888 | Appel . | |
| 1,933,776 | 11/1933 | Tooker | 383/126 X |
| 2,059,200 | 11/1936 | Bancroft | 383/126 X |
| 2,353,605 | 7/1944 | Waters | 383/126 |
| 2,496,796 | 2/1950 | Kardon . | |
| 2,777,368 | 1/1957 | Koop . | |
| 3,237,534 | 3/1966 | Lissner . | |
| 3,342,402 | 9/1967 | Kardon . | |
| 3,397,622 | 8/1968 | Goodwin . | |
| 3,519,195 | 7/1970 | Kuhnle | 383/126 |
| 3,734,395 | 5/1973 | Erk et al. . | |
| 4,490,131 | 12/1984 | Coleman et al. . | |

FOREIGN PATENT DOCUMENTS

| | | |
|---|---|---|
| 1175846 | 4/1959 | France . |
| 2393673 | 9/1979 | France . |

*Primary Examiner*—Jes F. Pascua
*Attorney, Agent, or Firm*—Hill, Steadman & Simpson

[57] ABSTRACT

A flat-bottom bag is provided having a folded bottom. Improved adhesive patterns are provided on the bag prior to folding. A first adhesive is provided in a plurality of parallel lines interiorly disposed in a bottom end of the bag. The lines are arranged on front and rear walls parallel to the side walls so that one outer line is positioned on each side of the front and rear walls with corresponding inner lines positioned so that when the sides are folded inwardly, each outer line intersects and contacts one respective inner line in an overlapping manner. This arrangement provides a securing of all interior edges of the folded bottom. A second adhesive can be applied to the exterior of the bag to bond front and rear flap extensions to each other and to the folded sides, forming the flat bottom. In an embodiment, an outer bottom flap is formed by slits in the front flap extension.

22 Claims, 6 Drawing Sheets

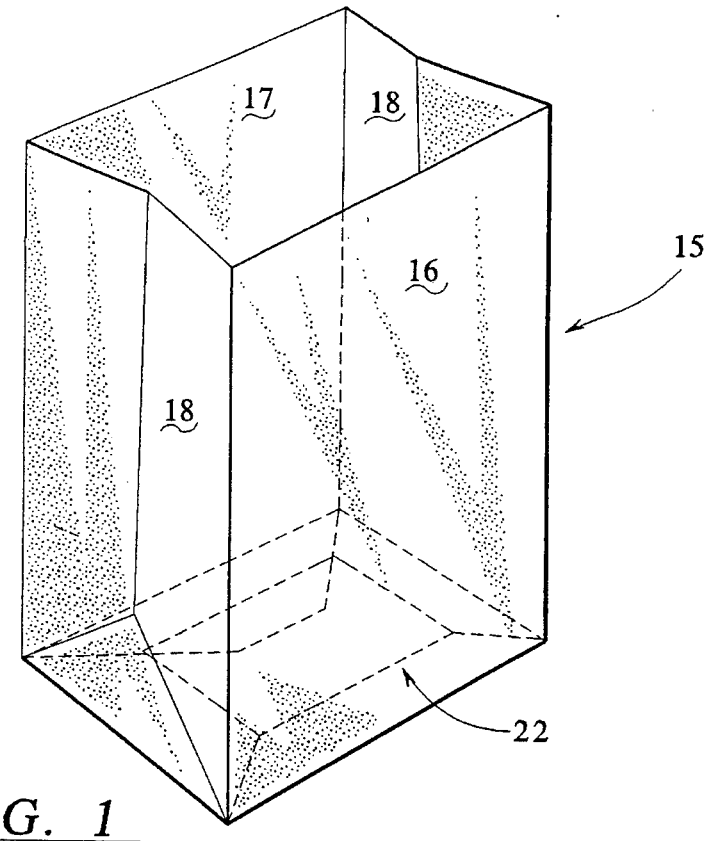
FIG. 1
FIG. 2
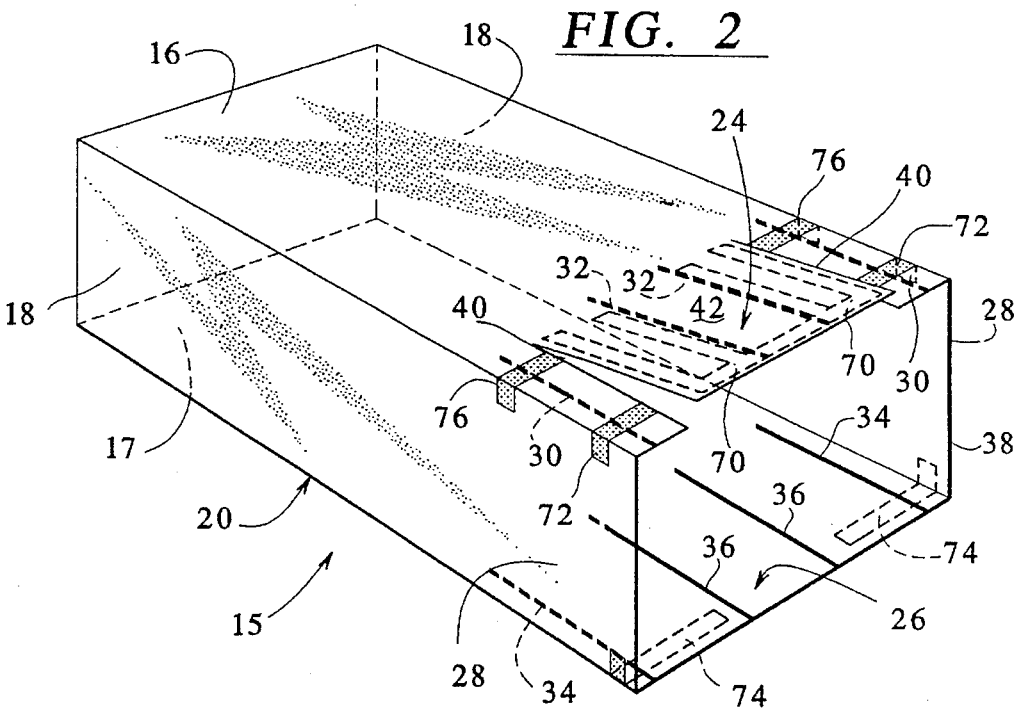

FIG. 6
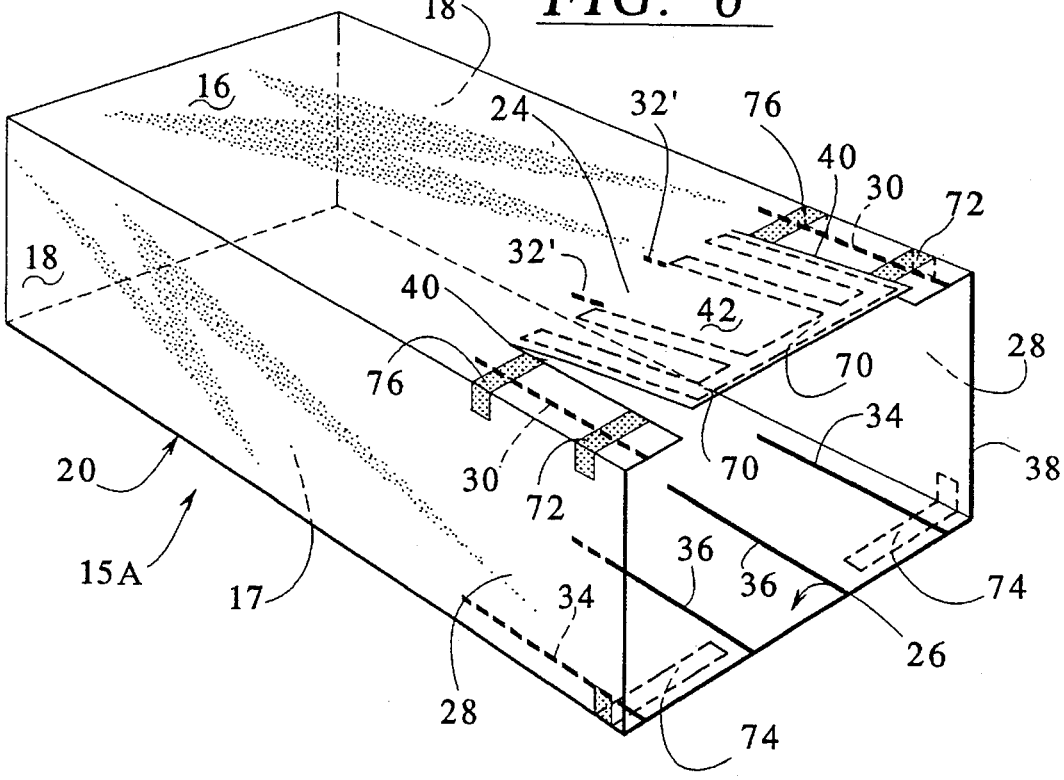
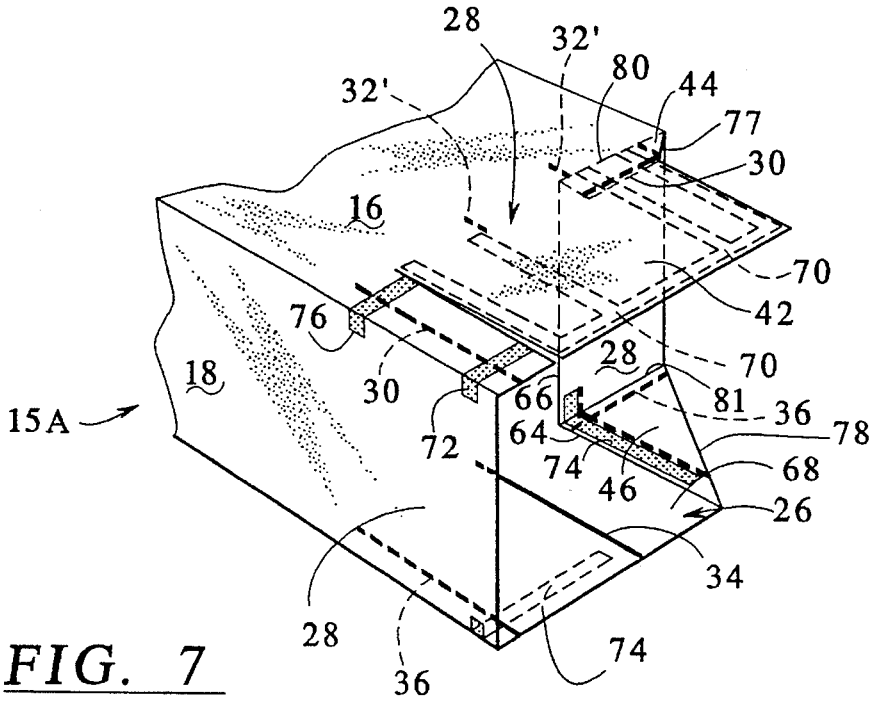
FIG. 7

QUASI-HEAT SEAL SOS BAG

BACKGROUND OF THE INVENTION

The present invention relates to bags. More specifically, the present invention relates to self-opening style or self-opening square bags, referred to in the industry as SOS bags. This type of bag has a folded rectangular bottom, and is typically used for grocery sacks, lunch sacks, microwave popcorn sacks and other bags which are required to stand on their own when opened. Such SOS bags are disclosed in U.S. Pat. Nos. 3,342,402; 3,606,822; 3,669,347; and 4,490,131.

Tubular sacks with gussetted sides are known. Because the bottom of such a bag is folded, the interior of the bag has folded-over flaps. Unfortunately, small-objects within the bag can become trapped under the flaps, making them difficult to retrieve.

It is known to apply an adhesive to a tubular bag to form and secure the rectangular bottom. However, the adhesive in prior art bags has not been optimally placed so that the bottom flaps are adequately secured. Some prior art configurations secure interior flaps by gluing an insert strip over certain flap edges. For example, U.S. Pat. No. 3,734,395 relates to such a bag.

Desirably, a minimal amount of adhesive is used for producing a bag to keep down costs. Therefore, the adhesive is preferably arranged for a maximum sealing effect with a minimal adhesive expense.

SUMMARY OF THE INVENTION

The present invention provides a novel SOS bag which utilizes a tube with gussetted sides having a select pattern of adhesives applied on portions of the interior and exterior of the bag, near one end of the tube. The pattern is such that upon folding of the bag, a flat bottom is achieved which completely secures all interior flap edges. Also, the present invention provides an adhesive arrangement which utilizes two adhesives, allowing a more expensive adhesive for sealing certain areas and a less expensive adhesive for other areas.

To this end, a flat-bottom bag is provided having a generally planar front wall, a generally planar rear wall substantially parallel to the front wall, gussetted side walls connecting the front and rear walls, and a bottom end foldable to provide a flat bottom to the bag. The bottom includes a front flap extension of the front wall, a bottom flap extension of the rear wall, and second flap extensions of the side walls. The bag also has a pair of first adhesive patterns, one on an interior of the front wall, one on an interior of the rear wall. Each first adhesive pattern has a pair of outer lines disposed adjacently to the side walls at the bottom end and a pair of corresponding inner lines disposed between the outer lines. The inner and outer lines run parallel to the sides such that when the side flap extensions are folded inwardly each outer line intersects the corresponding inner line.

In an embodiment, the inner lines and the outer lines respectively run approximately the length of the front and rear flap extensions.

In an embodiment, the first adhesive pattern is preprinted from a heat-reactivatable adhesive.

In an embodiment, a pair of slits are provided in the front wall. Each slit extends upwardly from the bottom end in a direction parallel to the side walls. Each slit is disposed between respective inner and outer lines of the first adhesive pattern. An outer bottom flap being defined between the slits.

In an embodiment, a second adhesive pattern is provided on an interior of the outer bottom flap. The second adhesive pattern includes a pair of upwardly directed U-shaped portions. Each U-shaped portion is positioned between a respective slit and inner line of the first adhesive pattern. An open end of each U-shaped portion is directed upwardly, and the U-shaped portions are joined by a line extending along an edge of the outer bottom flap.

In an embodiment, the second adhesive pattern is a paste applied during a bottom-formation process prior to folding.

In an embodiment, a plurality of external adhesive lines are positioned to contact between edges of the side flap extensions and the front and rear flap extensions.

In another embodiment, a flat-bottom bag is provided having a generally planar front wall, a generally planar rear wall substantially parallel to the front wall, a pair of gussetted side walls connecting the front and rear walls, a front flap extension extending from the front wall, a rear flap extension extending from the rear wall, and a pair of side flap extensions extending from respective side walls. A pair of first adhesive patterns are also provided, one on an interior of the front flap extension and one on an interior of the rear flap extension. Each of the first adhesive patterns include a pair of outer lines and a corresponding pair of inner lines. These outer lines and the inner lines are arranged parallel to the side walls. Each of the front and rear flap extensions has a pair of diagonally-folded overlapping sections. The overlapping sections are formed by an inward folding of the side walls such that each outer line intersects and contacts a corresponding the inner line generally at a right angle.

In an embodiment, a pair of slits are provided in the front flap extension. Each slit is respectively disposed slightly inwardly of and parallel to the outer adhesive lines. The slits define an outer bottom flap.

In an embodiment, a second adhesive pattern is provided on the outer bottom flap. This second adhesive pattern has a pair of U-shaped portions, each U-shaped portion being disposed adjacently to respective the slits. An open end of each the U-shaped portion is directed upwardly. A line is disposed along a bottom edge of the outer bottom flap, joining the U-shaped portions.

In an embodiment, the second adhesive pattern is a paste printable on the bag immediately prior to folding.

In an embodiment, the first adhesive patterns are made of a heat-activatable adhesive which is pre-printable on the bag.

In an embodiment, a plurality of external adhesive strips positioned on surfaces of the front and rear flap extensions positioned to contact and bond against edges of the side flap extensions upon folding.

In an embodiment, a final adhesive strip is positioned generally on a center bottom edge of the front flap extension.

In a further embodiment, a flat-bottom bag is provided comprising a tube having a generally planar front wall, a generally planar rear wall substantially parallel to the front wall, and side walls connecting the front and rear walls. A bottom end of the tube is foldable to provide a flat bottom of the bag. The bottom has a front flap extension of the front wall, a rear flap extension of the rear wall, and side flap extensions of the side walls. The side flap extensions are inwardly foldable so that the front and rear flap extensions each have diagonally overlapping side portions folded over at a forty-five degree angle. A first adhesive is arranged interiorly of the tube for preventing objects from becoming interposed under interior edges of the folded flat bottom. The adhesive is arranged in a plurality of lines parallel to the side walls so that when the bottom end is folded, at least two lines intersect at each the diagonally overlapping portion.

In an embodiment, the first adhesive is heat reactivatable.

In an embodiment, the second adhesive is arranged to hold the front and rear flap extensions against the side flap extensions to prevent items in the bag from becoming interposed between the side flap extensions and the front and rear flap extensions.

In an embodiment, a pair of slits are disposed in the front flap extension defining an outer bottom flap. The second adhesive is arranged in a pattern on the outer bottom flap, the pattern extending along each edge of the outer bottom flap and in strips positioned to contact adjacently to an edge of each side flap extension for preventing objects in the bag from becoming interposed between the outer bottom flap and the side flaps.

In an embodiment, the pattern on the outer bottom flap further extends onto the side flap extensions.

In an embodiment, the second adhesive is arranged in strips exteriorly of the tube on a bottom edge of the front and rear flap extensions so that when the bottom end is folded, the exterior second adhesive is at an edge of the overlapping portions.

An advantage of the present invention is to provide a bag that prevents objects contained therein from becoming entrapped under edges of a folded bottom.

A further advantage of the present invention is to provide a bag that has an efficient adhesive pattern that results in a beneficial sealing of a folded bottom.

Another advantage of the present invention is to provide a bag that has adequately secured exterior flaps.

Additional features and advantages of the present invention are described in, and will be apparent from, the detailed description of the presently preferred embodiments and from the drawings.

BRIEF DESCRIPTION OF THE DRAWINGS

FIG. 1 is a perspective view of a folded bag of the present invention.

FIG. 2 is a perspective bottom view of the bag of FIG. 1 in an unfolded condition.

FIG. 6 is a perspective bottom view of an unfolded bag pursuant to another embodiment of the present invention.

FIG. 7 is a partial perspective bottom view of the bag of FIG. 6 in an initial folding stage.

DETAILED DESCRIPTION OF THE PRESENTLY PREFERRED EMBODIMENTS

Figure 3:
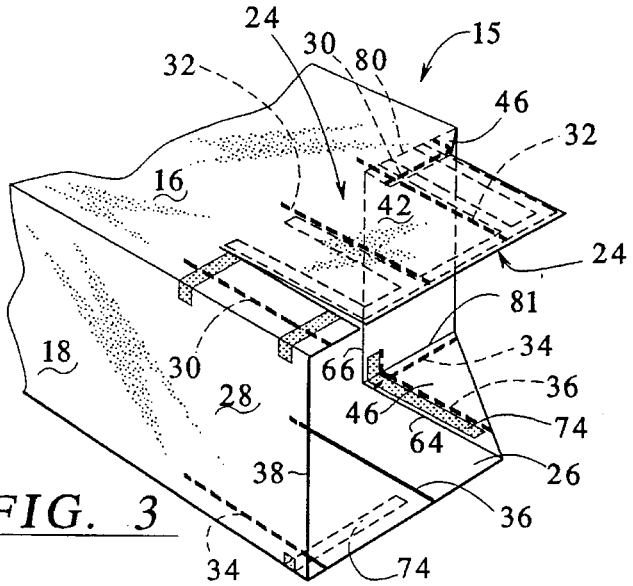
FIG. 3 is a partial perspective bottom view of the bag of FIG. 2 in an initial folding stage.
Figure 4:
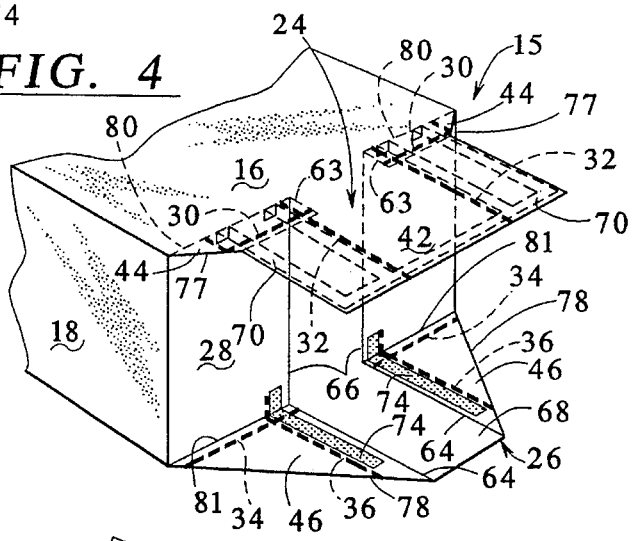
FIG. 4 is a partial perspective bottom view of the bag of FIG. 3 in a second folding stage.
Figure 5:
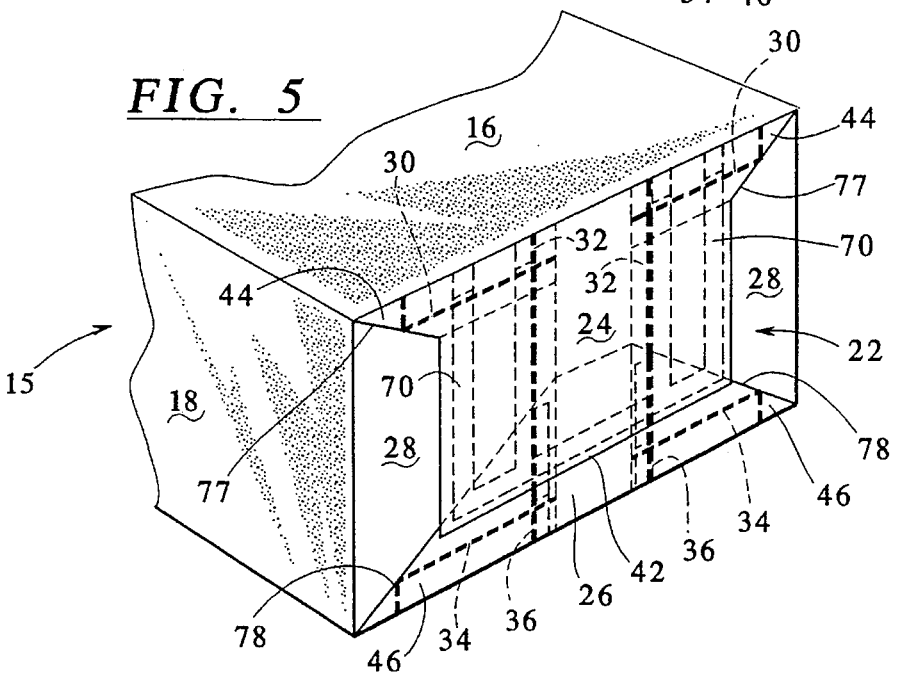
FIG. 5 is a partial perspective bottom view of the bag of FIG. 4 in a final folded stage.

In accordance with the invention described with reference to the accompanying figures wherein like numerals designate like parts, a flat-bottom bag 15 is provided, as illustrated in FIGS. 1–5. The bag 15 has a planar front wall 16, a planar rear wall 17, gussetted side walls 18 which connect the front 16 and rear walls 17 to form a tube 20, as illustrated in FIG. 2. A bottom end of the tube 20 is foldable to form a flat bottom 22 of the bag 15 (FIGS. 1 and 5).

As illustrated in FIG. 2, a front flap extension 24 extends from the front wall 16. A rear flap extension 26 extends from the rear wall 17. Two side flap extensions 28 are provided, each extending from one of the side walls 18. FIG. 2 illustrates the tubular bag 15 of the invention prior to folding.

Still referring to FIG. 2, the present invention provides a first adhesive indicated in dark lines. On an interior of the front flap extension 24, a pair of outer lines 30 as well as a pair of inner lines 32 are provided. The outer lines 30 are positioned adjacently to the respective side flap extensions 28.

Similarly, on an interior of the rear flap extension 26, a pair of outer lines 34 as well as a pair of inner lines 36 are provided. The outer lines 30 are each positioned adjacently to one of the side flap extensions 28. In the unfolded condition illustrated in FIG. 2, the lines 30, 32, 34, 36 are all parallel to each other and parallel to the side walls 18, i.e., lengthwise with respect to the tube 20.

In the embodiment of FIGS. 1–5, the first adhesive lines 30, 32, 34, 36 are all approximately the same length, running upwardly from a bottom edge 38 of the tube 20. The first adhesive is preferably a material which can be pre-printed on the tube 20 in the lines 30, 32, 34 and 36, dried or cured, and then reactivated with heat upon a folding of the bottom 22.

Also, in the embodiment illustrated in FIGS. 1–5, two slits 40 are provided in the front flap extension 24. An outer bottom flap 42 portion of the front flap extension 24 is defined between the slits 40.

As illustrated in FIGS. 3 and 4, the side walls 18 are folded inwardly. This inward folding of the side walls 18 respectively results in two diagonally folded double-layered overlapping portions 44 on the front flap extension 24 and two diagonally folded double-layered overlapping portions 46 on the rear flap extension 26. The diagonal folding takes place along an angled crease 77 and 78 at each side of the front and rear flap extensions, each crease being preferably angled at forty-five degrees.

Still referring to FIGS. 3 and 4, the bottom edge 38 of the tube 20 (FIG. 2) during folding forms an inner edge 64 of each rear overlapping portion 46 which is contiguous with an inner edge 66 of the adjacent side flap extension 28. On the rear flap extensions, the inner edges 64 of the respective pair of overlapping portions 46 are spaced apart and separated by a rectangular single-layered area 68. Also, inner edges 63 of the front flap overlapping portions 44 are contiguous with the inner edges 66 of the folded-in side flaps extensions 28.

In the folded conditions illustrated in FIGS. 4 and 5, the arrangement of the lines 30, 32, 34, 36 is such that each outer line 30 and 34 intersects a respectively adjacent inner line 32, 36 at generally a right angle. This provides a sealing of the bottom to prevent items in the bag 15 from becoming interposed in the overlapping portions 44 and 46.

As illustrated in FIGS. 2–5, a second adhesive is applied to various portions of the bottom end of the bag 15 for bonding the bottom in a folded condition. The second adhesive is preferably a bottom paste composition which can be applied during the bottom formation process prior to folding. The second adhesive is applied in a pattern 70 on the interior of the front flap extension. The pattern 70 is generally shaped as two U-shaped portions connected by a strip.

Also illustrated in FIG. 2 are a plurality of exterior adhesive strips 72, 74 and 76 of preferably the second adhesive. Two exterior adhesive strips 72 are positioned adjacent a bottom edge of the front wall 16, and two exterior adhesive strips 74 are positioned adjacent a bottom edge of the rear wall 17. Also, two exterior adhesive strips 76 are positioned on the top flap extension 24 on the portions thereof, outside of the slits 40, near the tops of the slits 40. Each exterior adhesive strip is opposite and approximately equal in length to the respective overlapping portions 40, 46. Each exterior adhesive strip 72, 74 and 76 extends inwardly from an adjacent side wall 18.

From the interior of the bag 15, the separate layers of the overlapping portions are open into the interior along fold lines, along their inner edges 64. The placement of the first adhesive lines 30, 32, 34 and 36 are such that the bag 15 is secured together along these openings to prevent bag contents from becoming trapped.

Furthermore, the second adhesive secures the inner edges 63, 64 of the overlapping portions 44 to the interior edges 66 of the side flap extensions 28. This prevents objects contained in the bag 15 from entering between the overlapping portions 44, 46 and the side flap extensions 28.

The interior adhesive lines 30, 32, 34 and 36 are preferably a first adhesive that can essentially be printed and dried or cured on the tube 20 prior to folding. The first adhesive can then reactivated by heat during the bottom-formation process, causing a bond. Especially suited compounds are Heat Seal Polyvinyl Acetate and Heat Seal Polyvinyl Alcohol (hereinafter collectively "HS-PVA") or hot melt adhesives. However, other heat reactivated adhesives could be used in lieu of HS-PVA or hot melt adhesives.

The second adhesive pattern 70, the exterior adhesive strips 72, 74 and 76 are preferably formed of a bottom paste which can be any glue or paste that can adhere to the bag material to form a bond. The second adhesive is preferably a less expensive material than the first adhesive. The second adhesive can be applied during the bottom formation process after the side flap extensions 28 have been folder inwardly when the bag 15 is in a flattened condition. Then, after the second adhesive is applied, the front and rear flap extensions are folded along fold lines 80 and 81, respectively, against the side flap extensions 28 to form the flat bottom 22.

As illustrated in FIG. 4, the first adhesive lines 30, 32, 34, 36, the second adhesive pattern 70 and the exterior adhesive strips 74 preferably each slightly intersect the adjacent creases 77 and 78. This allows for manufacturing deviations within tolerance limits to ensure adequate sealing. However, first adhesive lines 30, 32, 34, and 36 must not extend beyond the fold lines 80 and 81.

When the bottom 22 has been completely folded, as illustrated in FIG. 5, heat is applied to reactivate the first adhesive. The pattern 70 of the second adhesive forms a secure bonding of the front flat extension 24. This forms a complete securing of the folded bottom 22. The pattern 70 is configured to seal the edges of the outer bottom flap 42 against the bottom 22. Also, inner portions of the pattern 70 are positioned to align and seal against the inner edges 66 of the side flap extensions 28.

FIGS. 6–9 illustrate another bag 15A according to the present invention which is the same except that it utilizes slightly less adhesive than the embodiment of FIGS. 1–5. Because slightly less adhesive is used, the bag 15A as illustrated in FIGS. 6–9 costs less to manufacture. The bag 15A can be used where the sealing requirements are less demanding.

Figure 8:
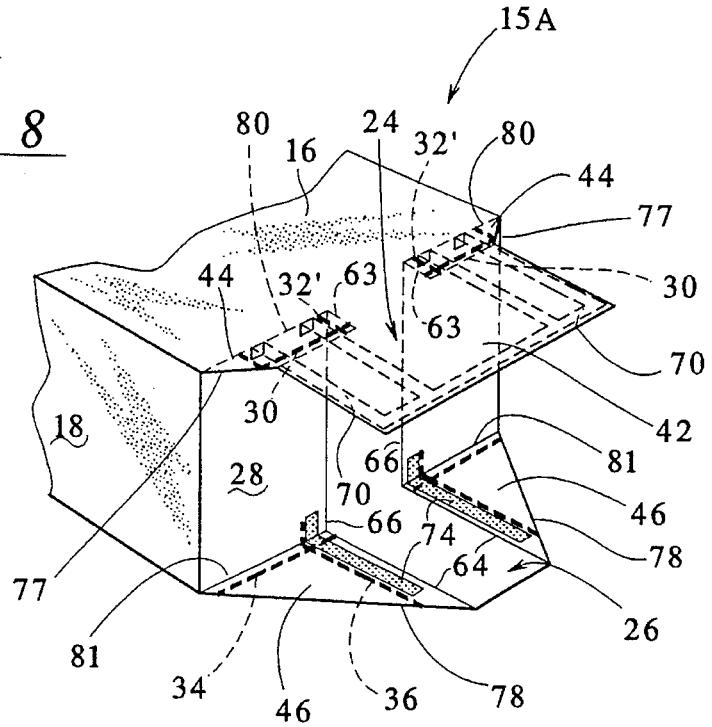
FIG. 8 is a partial perspective bottom view of the bag of FIG. 7 in a second folding stage.
Figure 9:
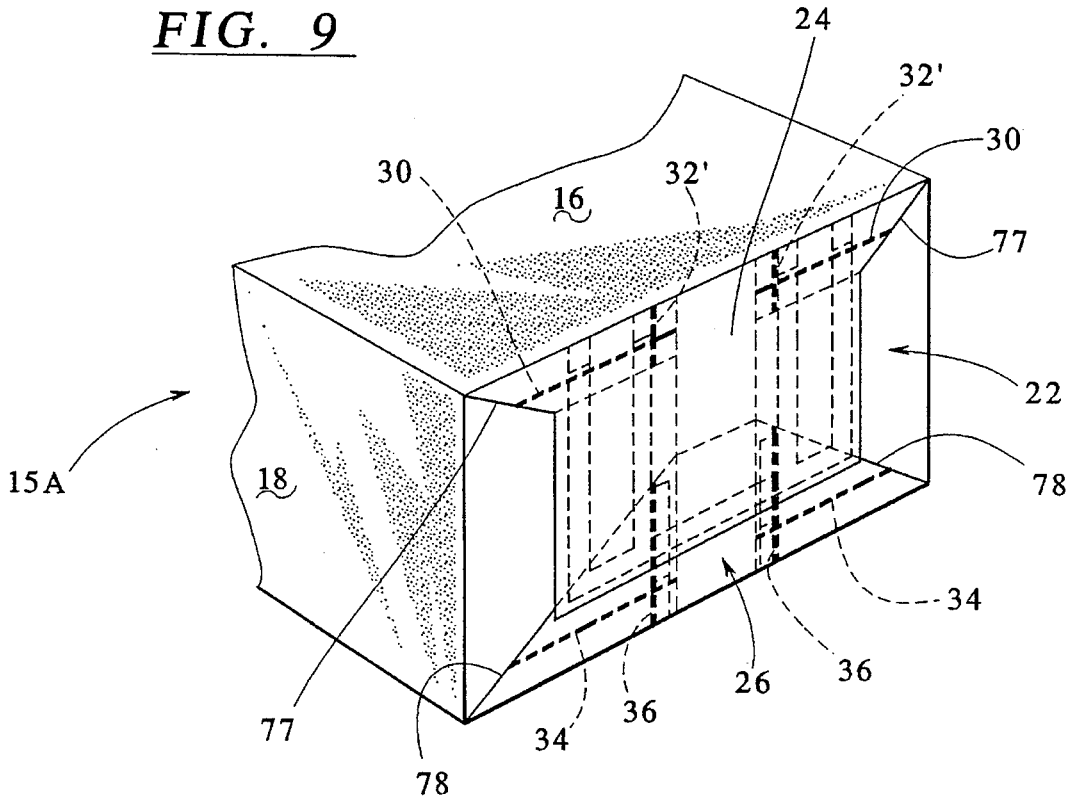
FIG. 9 is a partial perspective bottom view of the bag of FIG. 8 in a final folded stage.
Figure 10:
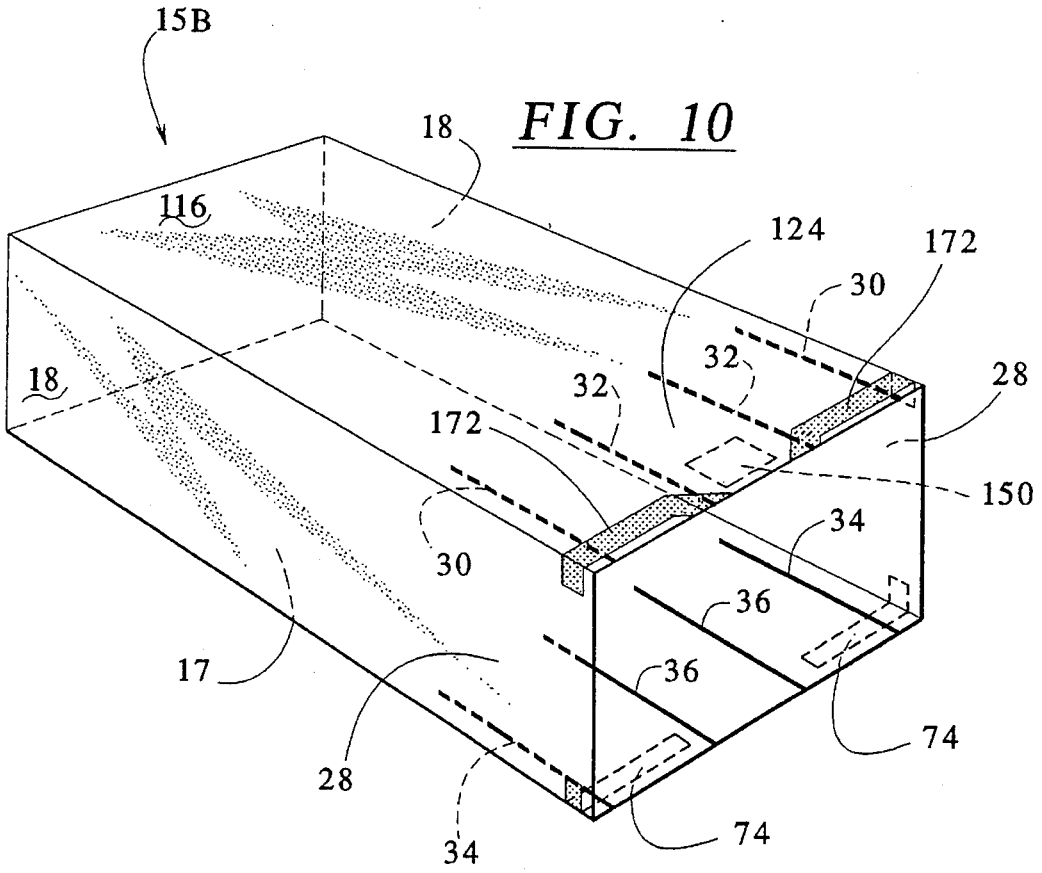
FIG. 10 is a perspective bottom view of an unfolded bag pursuant to another embodiment of the present invention.

As illustrated in FIG. 6, the bag 15 is different only in that the first adhesive at inner lines 32' of the front flap extension are shorter than the corresponding lines 32 in the previously described embodiment of FIGS. 1–5. The inner lines 32' are parallel to the outer lines 30. The side flap extensions 28 fold inwardly in the same manner, as shown in FIGS. 7 and 8, resulting in a crossing of the outer lines 30 and 34 of first adhesive to cross the corresponding inner lines 32' and 36, respectively. The rear 26 and front 24 flap extensions are then folded so that the outer bottom flap 42 is sealed flatly across the bottom, as illustrated in FIG. 9.

As illustrated in FIG. 8, the first adhesive lines 30, 34, 36 preferably slightly intersect creases 177 and 78 as in the previous embodiment.

FIGS. 10–13 illustrate a further embodiment of the present invention which includes a bag 15B with a front flap extension 124 having no slits. Such a bag formation is sometimes referred to as a diamond-fold bag. For this bag, the slit-making manufacturing step is avoided, saving expense. Thus, the bag 15B has a front wall 116 with a front flap extension 124 having no outer bottom flap 42 (of FIGS. 1–9). As a consequence, on the bag 15B, the front flap extension 124 folds to have full-sized overlapping portions 144 (FIGS. 11 and 12) similar in shape to the overlapping portions 46 on the rear flap extension 26. The front flap extension 124 is folded against the rear flap extension 26 to form a bottom 122 of the bag 15B.

Figure 11:
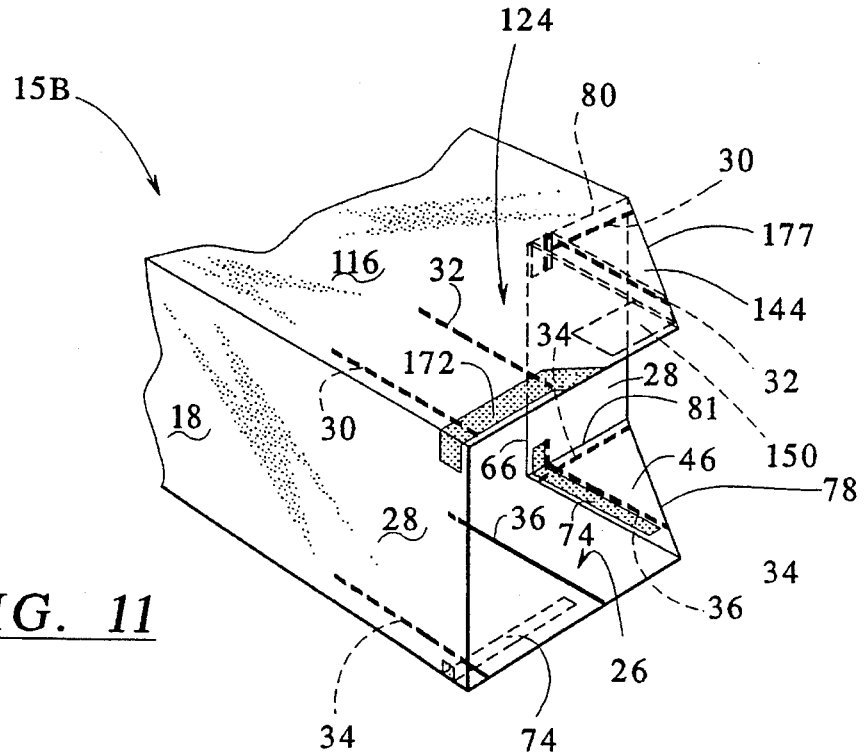
FIG. 11 is a partial perspective bottom view of the bag of FIG. 10 in an initial folding stage.

In this embodiment, the inner lines 32, 36 of the first adhesive and outer lines 30, 34 of the first adhesive are positioned in the same manner as the previously-described embodiments. Upon an inward folding of the side flap extension 28, as illustrated in FIGS. 11 and 12, the outer lines 30 and 34 intersect and contact across respective inner lines 32 and 34 at generally right angles.

Figure 12:
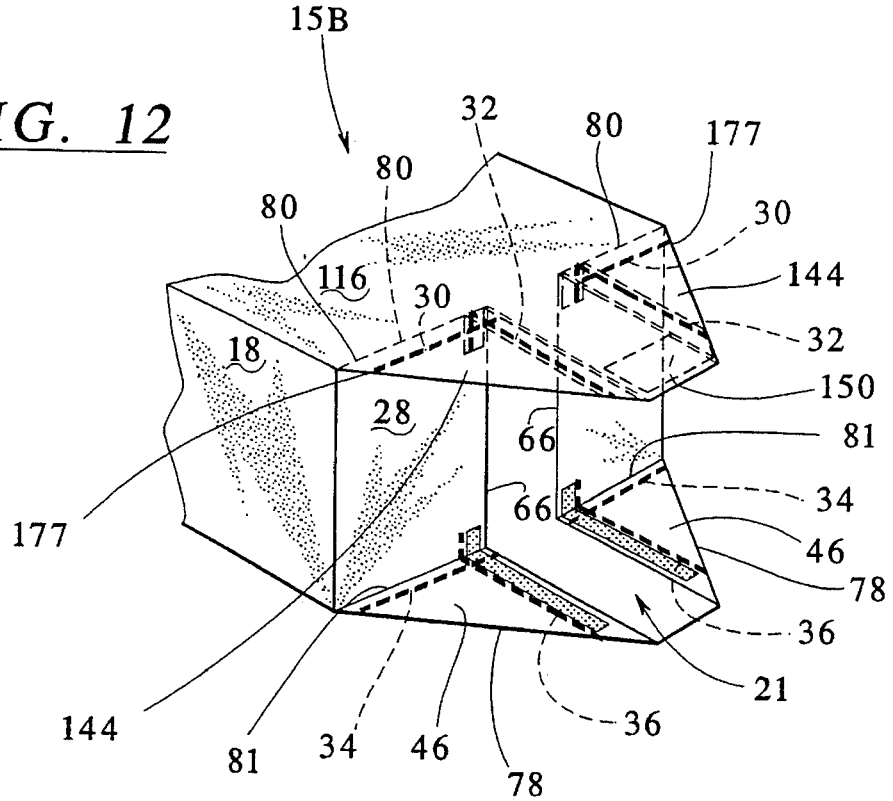
FIG. 12 is a partial perspective bottom view of the bag of FIG. 11 in a second folding stage.
Figure 13:
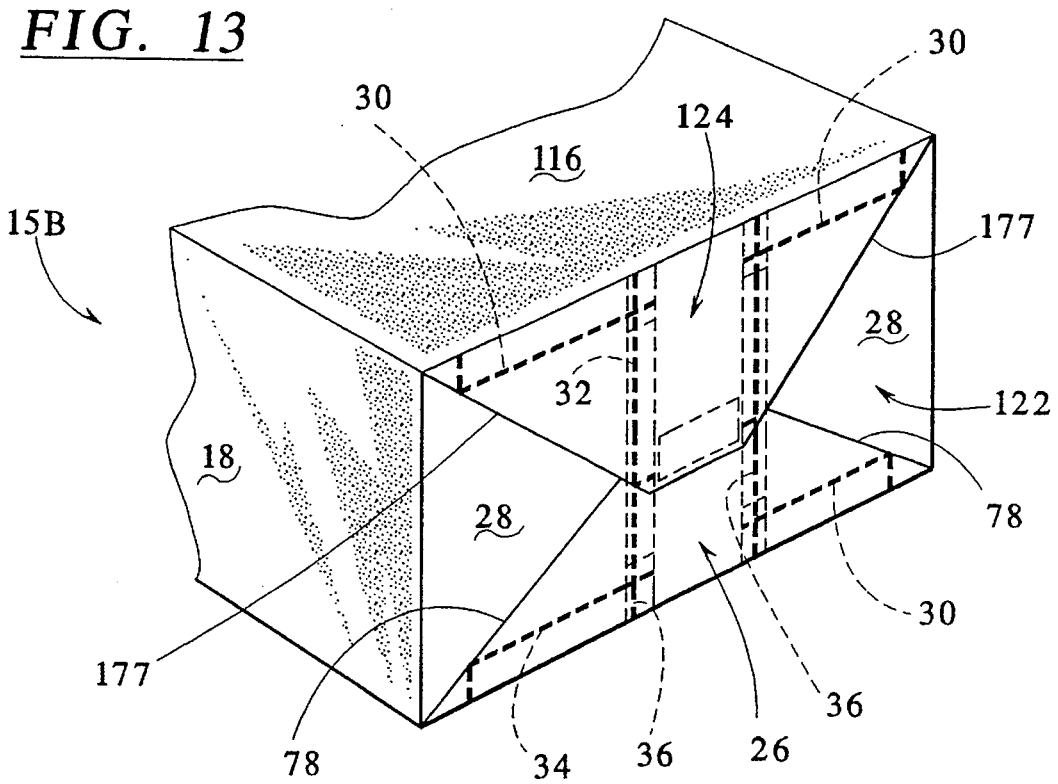
FIG. 13 is a partial perspective bottom view of the bag of FIG. 12 in the final folded stage.

As illustrated in FIGS. 12 and 13, the rear flap extension 26 and front flap extension 124 are folded to form the flat bottom 122. The external adhesive strips 174 are positioned on the rear flap extension 26 so that the rear flap extension 26 is bonded against interior edges 66 of inwardly-folded side flap extensions 28. Exterior adhesive strips 172 are positioned on the front flap extension 124 which is bonded against the interior edges 66 of the side flap extensions 28 and against the rear flap extension 26. A final adhesive strip 150 of the second adhesive is positioned on a portion of the front flap extension 124 which overlaps the rear flap extension 26 for bonding them together. The bag 15B does not have the U-shaped adhesive pattern. The final adhesive strip 150 secures the front and rear flap extensions together, and sealing is performed by the intersecting first adhesive lines 30, 32, 34, 36 and the exterior adhesive strips 74 and 172. As in the previously described embodiments, the bonded bottom 122 seals the interior edges of the bag to prevent objects in the bag 15B from becoming interposed under layers of the bag 15B.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A flat-bottom bag comprising:

a generally planar front wall;

a generally planar rear wall substantially parallel to said front wall;

gussetted side walls connecting said front and rear walls; and a bottom end foldable to provide a flat bottom to said bag, said bottom comprising a front flap extension of said front wall, a bottom flap extension of said rear wall, and side flap extensions of said side walls;

a pair of first adhesive patterns, one on an interior of said front wall, one on an interior of said rear wall, each first adhesive pattern comprising a pair of outer lines disposed adjacently to said side walls at said bottom end, a pair of corresponding inner lines disposed between said outer lines, said inner and outer lines running parallel to said sides, such that when said side flap extensions are folded inwardly, each outer line intersects one of said corresponding inner lines.

2. The bag according to claim 1 further comprising:

a plurality of diagonal creases, one of said creases being defined at each side of said front and rear flap extensions by said inward folding of said side flap extensions;

wherein said outer lines on said front flap extension intersect said creases on said front flap extension; and wherein said outer lines and said inner lines on said rear flap extensions intersect said creases on said rear flap extension.

3. The bag according to claim 2 wherein said inner lines on said front flap extension intersect said creases on said front flap extension.

4. The bag according to claim 1 wherein said inner lines and said outer lines respectively run at least the length of said front and rear flap extensions.

5. The bag according to claim 1 wherein said first adhesive pattern is preprinted from a heat-reactivatable adhesive.

6. The bag according to claim 1 further comprising:

a pair of slits in said front flap extension, each slit extending upwardly from said bottom end in a direction parallel to said side walls, each said slit being disposed between a respective inner and outer lines of said first adhesive pattern, said slits forming an outer bottom flap.

7. The bag according to claim 6 further comprising:

a second adhesive pattern on an interior of said outer bottom flap, said second adhesive pattern including a pair of upwardly directed U-shaped portions, each U-shaped portion being positioned between a respective slit and inner line of said first adhesive pattern, an open end of each U-shaped portion being directed upwardly, said U-shaped portions being joined by a straight adhesive portion extending along an edge of said outer bottom flap.

8. The bag according to claim 7 wherein said second adhesive pattern is a paste applied during a bottom-formation process prior to folding.

9. The bag according to claim 1 further comprising:

a plurality of external adhesive lines positioned to contact between edges of said side flap extensions and said front and rear flap extensions.

10. A flat-bottom bag comprising:

a generally planar front wall;

a generally planar rear wall substantially parallel to said front wall;

a pair of gussetted side walls connecting said front and rear walls;

a front flap extension extending from said front wall;

a rear flap extension extending from said extending from said rear wall;

a pair of side flap extensions, each extending from one of said side walls;

a pair of first adhesive patterns, one on an interior of said front flap extension and one on an interior of said rear flap extension, each said first adhesive pattern comprising a pair of outer lines and a corresponding pair of inner lines, said outer lines and said inner lines being arranged parallel to said side walls;

wherein each front and rear flap extension has a pair of diagonally-folded overlapping sections, said overlapping sections formable by an inward folding of said side walls such that each outer line intersects and contacts the corresponding inner line generally at a right angle.

11. The bag according to claim 10 further comprising:

a pair of slits in said front flap extension, each said slit being respectively disposed slightly inwardly of said outer adhesive lines and parallel thereto, an outer bottom flap being defined between said slits.

12. The bag according to claim 11 further comprising:

a second adhesive pattern on said outer bottom flap, said second adhesive pattern having:

a pair of U-shaped portions, each U-shaped portion being disposed adjacently to one of said slits, an open end of each U-shaped portion being directed upwardly; and a line disposed along a bottom edge of said outer bottom flap joining said U-shaped portions.

13. The bag according to claim 12 wherein said second adhesive pattern is a paste applied to the bag prior to a final folding step.

14. The bag according to claim 10 wherein said first adhesive patterns are made of a heat-activatable adhesive which is pre-applied on the bag.

15. The bag according to claim 10 further comprising: a plurality of external adhesive strips positioned on an exterior of said front and rear flap extensions for bonding said front and rear flap extensions against said side flap extensions in a folded condition.

16. The bag according to claim 10 further comprising:

a final adhesive strip positioned on an interior of said front flap extension between said overlapping portions.

17. A flat-bottom bag comprising:

a tube having a generally planar front wall, a generally planar rear wall substantially parallel to said front wall, and side walls connecting said front and rear walls;

a bottom end of said tube folded to provide a flat bottom of said bag, said bottom comprising a front flap extension of said front wall, a rear flap extension of said rear wall, and side flap extensions of said side walls, said side flap extensions being inwardly folded so that each of said front and rear flap extensions each has a pair of diagonally overlapping side portions folded over at a forty-five degree angle;

a first adhesive arranged interiorly of said tube to prevent objects from becoming interposed under interior edges of said folded flat bottom, said adhesive being arranged in a plurality of lines parallel to said side walls before said bottom end is folded, so that when said bottom end is folded, at least two of said lines intersect at a right angle at each said diagonally overlapping portion.

18. The bag according to claim 17 wherein said first adhesive is heat reactivatable.

19. The bag according to claim 17 further comprising:

a second adhesive arranged to hold said front and rear flap extensions against said side flap extensions for preventing items in said bag from becoming interposed between said side flap extensions and said front and rear flap extensions.

20. The bag according to claim 19 further comprising:

a pair of slits in said front flap extension defining an outer bottom flap;

wherein said second adhesive is arranged in a pattern on said outer bottom flap, said pattern extending along each edge of said outer bottom flap and in strips positioned to contact adjacently to an edge of each said side flap extension for preventing objects in said bag from becoming interposed between said outer bottom flap and said side flaps.

21. The bag according to claim 20 wherein said pattern on said outer bottom flap further extends onto said side flap extensions.

22. The bag according to claim 19 wherein said second adhesive is arranged in strips exteriorly of said tube on a bottom edge of said front and rear flap extensions along so that when said bottom end is folded, said exterior second adhesive is at an edge of said overlapping portions.

* * * * *

UNITED STATES PATENT AND TRADEMARK OFFICE

CERTIFICATE OF CORRECTION

PATENT NO. : 5,568,980

DATED : October 29, 1996

INVENTOR(S) : Jay L. Kristola

It is certified that error appears in the above-indentified patent and that said Letters Patent is hereby corrected as shown below:

Col. 5, line 53 replace "folder"
with --folded--

Claim 6, Col. 7, line 54
after "between" delete "a".

Claim 22, Col. 10, line 16
delete "along".

Signed and Sealed this

Twenty-fifth Day of August, 1998

Bruce Lehman

*Attest:*

BRUCE LEHMAN

*Attesting Officer*

*Commissioner of Patents and Trademarks*